US006371625B2

(12) United States Patent
Campman

(10) Patent No.: US 6,371,625 B2
(45) **Date of Patent: *Apr. 16, 2002**

(54) ALL SOLID-STATE OMNI DIRECTIONAL LUMINARY AND FLASHLIGHT

(76) Inventor: James P. Campman, P.O. Box 167, Transfer, PA (US) 16154

( * ) Notice: Subject to any disclaimer, the term of this patent is extended or adjusted under 35 U.S.C. 154(b) by 0 days.

This patent is subject to a terminal disclaimer.

(21) Appl. No.: 09/768,616

(22) Filed: Jan. 25, 2001

Related U.S. Application Data

(63) Continuation-in-part of application No. 09/197,569, filed on Nov. 23, 1998, now Pat. No. 6,213,623.

(51) Int. Cl.[7] ..... F21L 4/02

(52) U.S. Cl. ..... 362/184; 362/102; 362/158; 362/186; 362/190; 362/191; 362/206; 362/267; 362/84

(58) Field of Search ..... 362/102, 158, 362/184, 186, 190, 191, 206, 267, 84

(56) References Cited

U.S. PATENT DOCUMENTS

| | | | | |
|---|---|---|---|---|
| 5,081,568 A | * | 1/1992 | Dong et al. | 362/184 |
| 5,865,524 A | * | 2/1999 | Campman | 362/102 |
| 6,186,634 B1 | * | 2/2001 | Pitts | 362/84 |

* cited by examiner

*Primary Examiner*—Stephen Husar
*Assistant Examiner*—Guiyoung Lee
(74) *Attorney, Agent, or Firm*—Jacobson Holman, PLLC

(57) ABSTRACT

A laser lens glow baton is a hand held, dual purpose, visual signaling baton. This device can be used as a flashlight that projects a well-defined beam of light via its laser lens and assembly or as a highly visible luminary that radiates an intense flux of light similar to neon tube. The laser lens glow baton is useful as a visual-signaling device because the colors of the main body and the colors of the projected beam emitted from the laser lens assembly are easily changed. The laser lens glow baton may be easily fabricated in different lengths because of its compartmentalization of the components.

7 Claims, 3 Drawing Sheets

ALL SOLID-STATE OMNI DIRECTIONAL LUMINARY AND FLASHLIGHT

CROSS-REFERENCE TO RELATED APPLICATIONS AND PATENTS

This is a continuation-in-part of patent application Ser. No. 09/197,569, filed Nov. 23, 1998 now U.S. Pat. No. 6,213,623.

BACKGROUND OF THE INVENTION

1. Field of the Invention

The invention relates to flashlights. More specifically, the present invention is an all solid-state omni directional luminary and flashlight.

2. The Prior Art

Visual signaling is a common and easily understood method of relaying information from at least one person to another. Visual signaling is often used in environments hostile to other forms of communication. Such environments include traffic intersections, airports, mountain rages, underwater and the like. Provided the environment is hospitable to the transmission of light from a source point to a receiver point, visual signaling provides an effective means of communication.

One type of visual signaling device is a light baton or wand. Light batons are hand held devices which, at the control of the holder, emit colored or white light. Light batons are used to direct pedestrians, motor vehicles, aviation vehicles, and the like. The baton may be used to generate light signals indicting safe and clear passage, dangerous and hazardous conditions, directions to proceed, or identifying one's location.

A common problem encountered in use of light batons is the shortened life span of the baton from usage in hostile and rugged environments. These environments expose the baton to manual battering as well as the natural elements. As a result, a need exists for a light baton having characteristics that can withstand use in hostile and rigid environments.

U.S. Pat. No. 5,295,882 to McDermott includes a battery powered device. The device claimed is directed to a spring which supplements the gravitational force to position the device in an erect posture in water.

U.S. Pat. No. 5,622,423 to Lee is a traffic control light. It is not waterproof or appear to be submersible in water. The device includes numerous LEDs for illumination.

U.S. Pat. No. 3,016,549 to Finn is directed to an illuminating device with a floating device. The device is in two parts and must be detached from the illuminating portion.

U.S. Patent Nos. 2,893,344 to Meyers and 2,908,901 to Lewis each describes an audible alarm.

U.S. Pat. No. 2,364,787 to Harrison et al. related to a portable flashlight carried by a person afloat in water. However, it is a two part system and does not appear submersible.

SUMMARY OF THE INVENTION

In view of the problems and disadvantages of the prior art, the present invention seeks to provide a tubular structure made of a plastic material such as polypropylene, polyethylene, polyurethane or similar type plastic that exhibits an optical phenomena such that when the plastic tube is exposed to a light source contained within the tube, the entire tube tends to glow. The phenomena is due to the re-radiation of photons within the molecular structure of the polypropylene, polyethylene, and polyurethane or similar type plastic. This glowing phenomena is similar in appearance to a neon tube.

Furthermore, if the plastic tube is colored with a pigment such as a fluorescent red dye (or other color) and the tube is internally exposed to a red light source (a red LED or other color) the re-radiation phenomena of photons is greatly enhanced. This enhancement is caused by the affinity of the florescent dye pigment embedded within the plastic molecules of the tube for the red wavelength of light emitted from the red LED (or other color) contained within the tube.

The present invention provides a lightweight all solid state lighting source that is extremely easy to use with only one hand.

The mechanical design of the baton is a tube sealed at both ends with hemispheric shaped end caps. This type of design provides an extreme robustness and the baton can withstand extreme depths of submergence, making it useful for deep diving and submergence signaling applications. All interior electronics and solid state light sources are sealed from the outside atmosphere, thus making the glow baton explosion proof and waterproof.

The hand held light wand of the present invention is a visual signaling light emitting wand. This device is sealed at each end with hemispheric end caps. This shape permits the light wand to withstand extreme depths of submergence, thus making it useful for deep diving signaling applications.

The luminary and flashlight contained within a tubular structure includes a white LED or other color light source which is housed in a laser assembly and is affixed at one end of the tube. This assembly projects a well-defined beam of light which is used in a flashlight mode of operation.

Additionally, there is the broad beam red LED or other color light source which is contained within the tubular structure near the tube base and serves to illuminate the entire tube as a luminary.

Accordingly, it is an object of the invention to provide a laser lens assembly that projects a well defined beam of light located at the tip of the baton in combination with another LED located near the base of the baton.

Another object of the invention is to provide an arrangement of LEDS which cause the tubular polypropylene main body to glow as a luminary and the laser lens assembly projects a beam of light.

Another object of the present invention is to provide the light source in electrical communication with the power source via interior electronics and solid state light sources.

Another object of the invention is to provide machined exterior walls for the light baton to effectively transmit light from the light source.

A further advantage of the invention is that this type of design is extremely robust and can withstand extreme depths of submergence, making it useful for deep diving and submergence signaling applications.

It is a further object of the invention to seal all interior electronics and solid state light sources from the outside atmosphere, thus making the glow baton explosion and waterproof.

The laser lens glow baton makes an excellent traffic control baton for directing and signaling traffic flow. This device has a large omni-directional luminary surface that is useful as a personal luminary for tracking personnel in poorly lit areas and also serves as a solid-state flashlight.

The illuminating light sources are solid-state LEDs contained within a cylindrical tube. The cylindrical tube is made of a polypropylene or equivalent plastic. The LEDs contained within this tube cause the complete tube to radiate an omni-directional light similar to a neon tube. At one end of the tube is a handle grip. At the other end, the tip of the tube is a laser lens assembly that focuses a white beam of light. A choice of tip illumination only, main body illumination only or both tip and body illumination is achieved by rotating the base of the wand. The base also serves as an ON/OFF switch.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

A preferred structural system embodiment and preferred sub components of this invention are disclosed in the accompanying drawings in which.

DESCRIPTION OF THE INVENTION

Figure 1:
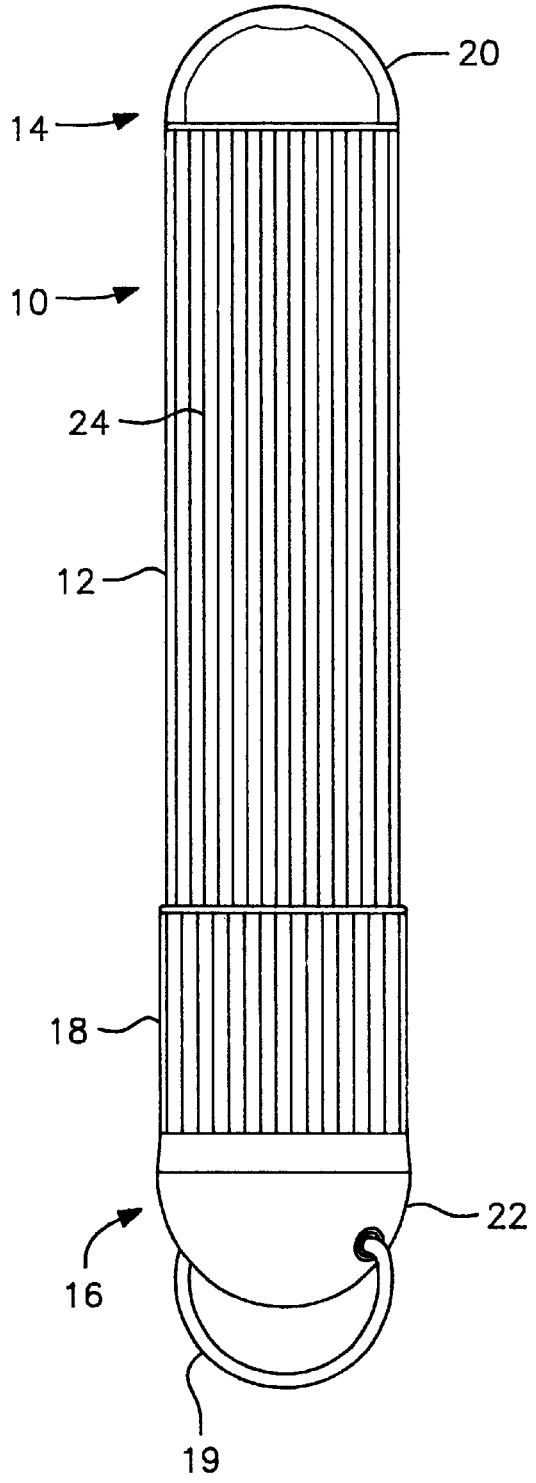
FIG. 1 is a perspective view of a preferred embodiment according to the present invention.

Although only a few preferred embodiments of the invention are explained in detail, and it is to be understood that the embodiments are given by way of illustration only. It is not intended that the invention is to be limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

FIG. 1 depicts a perspective view of an embodiment of the present invention. As shown, the present invention comprises a light baton 10 having an elongated, hollow, tubular body 12. Body 12 includes a contiguous forward portion 14 and rear portion 16 separated by a switch housing 18. Body 12 may be made of plastic, polyethylene or any resilient waterproof material. Forward portion 14 is translucent and may include light dispersing means coated thereon. Light dispersing means may include crushed prisms, knurled plastics of any other light dispersing means.

A front cap 20 is positioned at and contiguous with a forward distal end of forward portion 14. A back cap 22 is positioned at and contiguous with a rear distal end of rear portion 16.

In this embodiment, the light baton 10 measures a 13.5 inches long by 1.5 inches in diameter. It weighs a mere 9 ounces. The tubular surface area of body 12 is of a fluted design. The flutes 24 increase the surface area of the baton 10 and result in a more effective light radiation.

Figure 2:
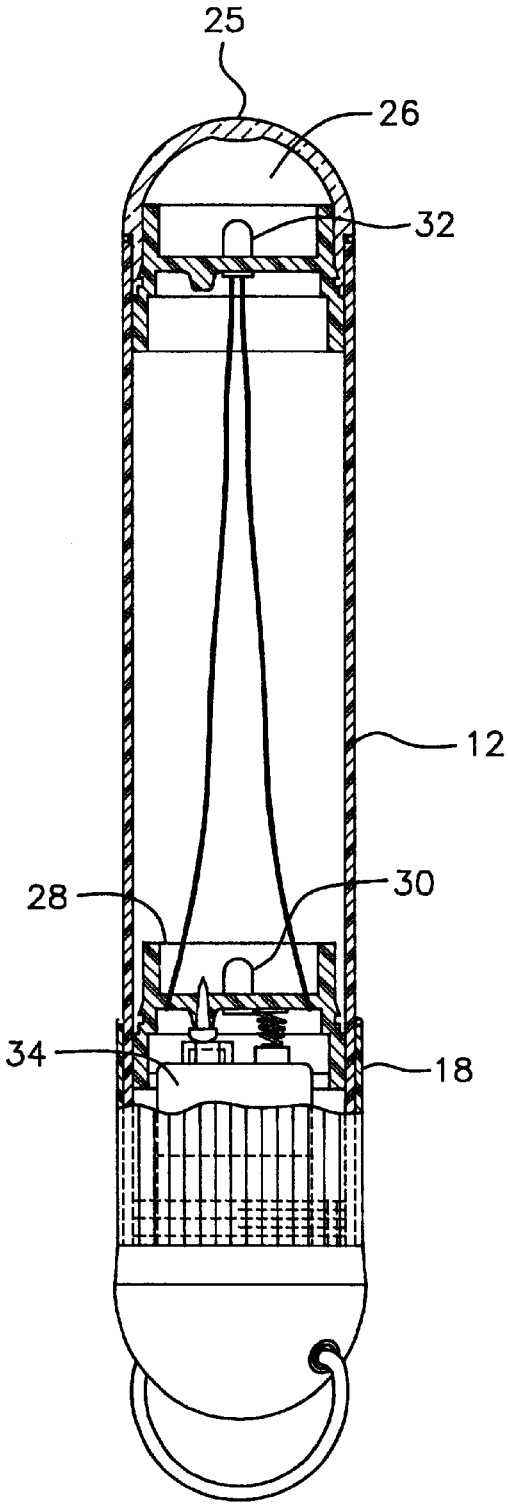
FIG. 2 is a partial cross section along the line II—II of FIG. 1.

FIG. 2 depicts a partial cross-sectional view of a laser lens glow baton assembly of FIG. 1. The overall length of the luminary surface may vary from 2" long to 15" long.

At the forward potion 14 in the front cap 20 is a lens 25 and assembly 26. By placing the lens 25 and assembly 26 at one end of the tubular body 12 and a partial assembly 28 without the lens towards the base or rear portion 16 of the fluted polypropylene tube 12, a two color system is realized. The length of the fluted polyethylene tube 12 can vary from 2" through 15". FIG. 2 shows the focusing lens 25 and assembly 26 in combination with a LED 32 for projecting a high resolution spot light.

The laser lens glow baton 10 is a hand held, dual purpose, visual signaling baton. This device or baton 10 can be used as a flashlight that projects a well-defined beam of light via its laser lens 25 and assembly 26 or as a highly visible luminary that radiates an intense flux of light similar to neon tube. The laser lens glow baton 10 is useful as a visual-signaling device because the colors of the main body and the colors of the projected beam emitted from the laser lens 25 and assembly 26 are easily changed. The laser lens glow baton 10 may be easily fabricated in 2" length for use as a personal flashlight.

The main body 12 is made of a polypropylene or similar type plastic that exhibits unique optical properties in addition to its excellent mechanical strength. All light sources are solid state LED'S. The end caps 20, 22 are made of a clear hemispheric shaped polycarbonate. This combination of materials result in an extremely robust device 10. This type of construction is completely waterproof and will withstand underwater submergence. The laser lens glow baton 10 has two or more light sources, a colored LED 30 which can be green, red, amber, etc. and is located in the switching housing 18, for illuminating the main body 12. A white or other color LED 32 is located in the front cap 20 for illuminating the laser lens 25 and assembly 26. This lens 25 and assembly 26 projects a well-defined beam of light.

The red color LED light source assembly 28 illuminates the main body 12. The main body 12 is made of polyethylene, polypropylene or polyurethane plastic. The optical properties of these types of plastic are such that when the molecular structure of these plastics are excited by being exposed to a light source such as the light emitted from an LED the following phenomena occurs. Photons that are emitted from the light sources cause the molecules within the polyurethane plastic structure (main body) to re-radiate photons in a highly diffused and random manner. This flux of photons causes all neighboring molecules within the structure to re-radiate photons thus causing the complete structure to flow similar to a neon tube.

Because the structure or body 12 is made of polyethylene, polypropylene, polyurethane or similar type plastic, it is extremely robust and is considered unbreakable. Various colors are easily obtained by adding color pigment dyes to the plastic. These dyed colors are an affinity for the various wavelengths of light emitted from the colored LEDS. Red dye for a red LED, green dye for a green LED, etc. Because the plastic structure re-radiates photons, the complete structure or body 12 appears to glow.

The mechanical design of the baton 10 is of a tube or body 12 which is sealed at both ends with the hemispheric end caps 20, 22. At one end 16 of the tube 12 is the handle grip 18 with a ring attachment 19. The base or back cap 22 also serves as an on/off switch. This overall type of design provides robustness and permits the glow baton 10 to withstand extreme depths of submergence. Thus, it is useful for deep diving and submergence signaling applications.

With reference to FIG. 2, located in the baton 10 in the interior cavity of rear portion is a power supply 34. The power supply 34 may be any battery source of electrical power known by the skilled artisan that provides sufficient electrical operation power, such as alkaline battery 34. Such a rechargeable battery will provide power for up to one week of continuous operation. Additionally, solar cells may be used as a charging source. When the baton 10 is made of transparent plastic, solar cells are easily placed inside this waterproof structure and are totally protected from mechanical damage. All interior electronics and solid state light sources are sealed from the outside atmosphere, thus making the baton 10 explosion proof and waterproof. The LEDs 30, 32 are in electrical communication with the power source 34.

The front cap 20 has translucent wall defining a forward hemispheric shape. The front cap 20 remains in optical communication with the internal cavity of forward portion 14. Front cap 12 may be composed of any suitable resilient water proof material such as plastic or glass.

Figure 3:
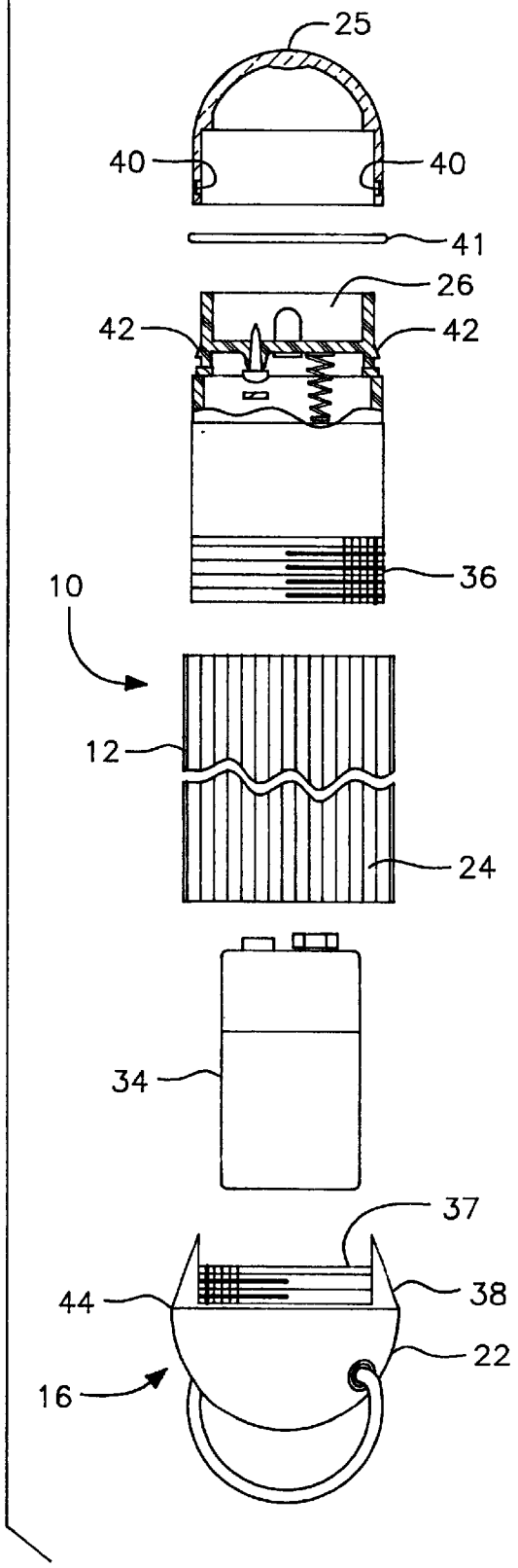
FIG. 3 is an exploded view of another embodiment of the present invention.

With reference now to FIG. 3, an exploded view of another embodiment of the glow baton 10 is shown. This embodiment is a smaller version of that shown in FIGS. 1 and 2. The rear distal end or portion 16 of body 10 includes internal threads 36 which communicate with threading 37 on a forward portion of back cap 22. The two treads communicate to secure the forward portion of end cap 22 within the internal cavity of rear portion 16. In addition, positioned about the forward portion of back cap 22 is gasket 38. The gasket 38 is held in place by the securing action of end cap 22 and rear portion 16. The gasket 38 facilitates watertight communication between the end cap 22 and the rear portion 16 of the baton 10.

In this exploded view of FIG. 3, the laser assembly 26 is compartmentalized and thus can be used in tubular lengths that range from 2 inches through 15 inches in length. The 2 inches long model is realized when the hemispheric lens cap 20 and the laser lens 25 is directly snapped into assembly 26. Captivating hole 40 is snapped over captivating barb 42. There is a standard "O" ring 41 attached.

The smaller fluted polypropylene main body 12 is then slipped over the total assembly 26 resulting in a luminary having only a two inch radiant surface. The high friction gasket seal 38 grips the fluted polypropylene main body 12. This provides for smooth rotary action of a rotary switch 44 which will be further explained with reference to FIGS. 4A, 4B, 4C, and 4D.

The high friction gasket seal 38 at the base 22 of the laser lens glow baton 10 provides a watertight integrity between the base 22 of the baton 10 and the fluted main body 12. The smooth rotary action of the base switch 44 is due to the friction between the elastic walls of the gasket seal 38 and the fluted ribs 24 of the main body 12.

Figure 4A:
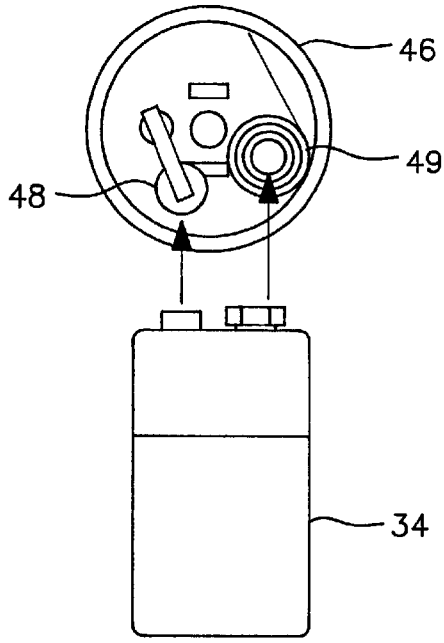
FIGS. 4A, 4B, 4C, and 4D are views of a battery connection for the present invention.

With reference to FIG. 4A, a battery ejection mechanism 46 includes a screw type contact 48 which is a positive contact and also an ejection spring 49 which is a negative contact. The ejection spring 49 serves a dual purpose. It provides a contact and facilitates easy removal of the battery 34, because the battery 34 is under spring pressure when the hemispheric end cap 22 is screwed into the tubular body 12. When the hemispheric end cap 22 is removed the spring tension is released and the battery 34 is ejected.

Figure 4B:
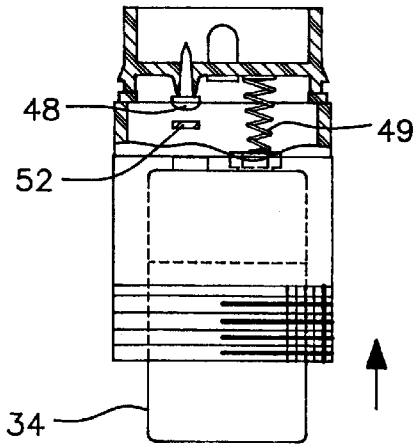
Figure 4C:
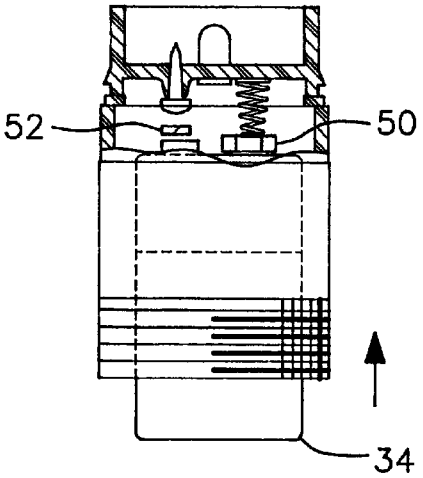
Figure 4D:
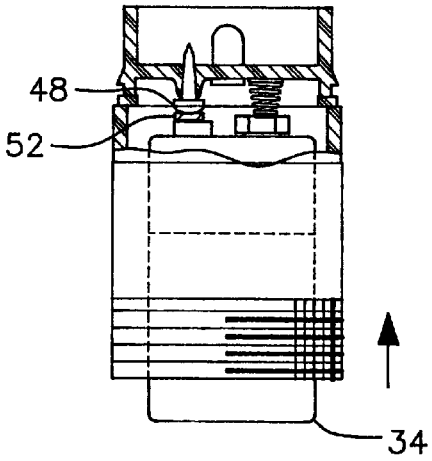

In FIGS. 4B, 4C and 4D, the activation of the baton 10 is described. The FIGS. 4B, 4C and 4D indicate the travel of the battery 34 contained within the tubular structure 12 and depicts the various switch closure. The baton 10 is activated by rotating the base or rear hemispheric cap 22 in a clockwise fashion. This action causes the battery 34 to move forward and the negative contact of the battery 34 touches the spring contact 49, see FIG. 4B, this causes the white LED 32 to illuminate. In FIG. 4C, further rotation of the base hemispheric cap 22 will cause a positive contact 52 of the battery to contact the positive screw contact 48. This will close the circuit, thus shorting all of the current from the white LED 32 to the red LED 30 and accomplishing the electronic switching of the LEDS, see FIG. 4D.

The on/off switch means contained within the hemispheric base 22 switches the laser lens glow baton 10 such that when the base 22 is rotated, the laser lens glow baton goes from an "off" state to an "on" state. In the "on" state, the main body 12 of the baton 10 glows. Further rotation of the base switch causes activation of the laser lens assembly 26 affixed at the end of the tube 12. This is the flashlight mode of operation. Both combinations of tip illumination and the main tubular glow can be obtained by rotating the hemispheric base 22 acting as a switch.

Figure 5:
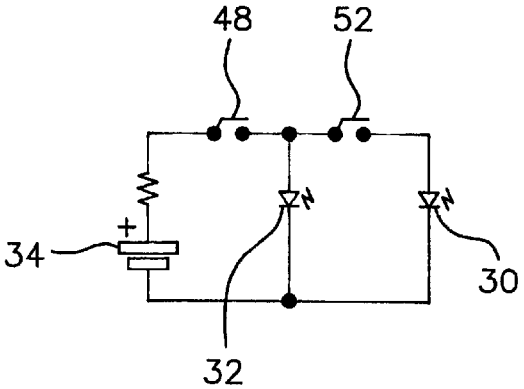
FIG. 5 is a circuit diagram of the present invention.
Figure 6:
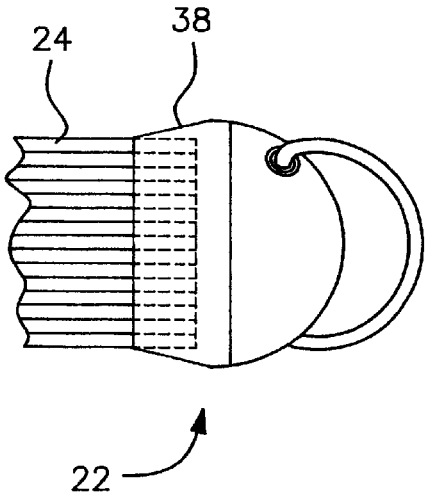
FIG. 6 is a side view of the rotary base switch of the present invention.

FIG. 5 shows the schematic diagram of the red LED 30 and the white LED 32 which operate in accordance with the accompanying truth table.

| #48 | #52 | LED |
|---|---|---|
| Open | Open | None |
| Closed | Open | White |
| Closed | Closed | Red |

The red LED 30 glows when both contacts 48 and 52 are closed. The red LED has a voltage drop Vr=1.7 volts and shunts all the current from the white LED 32 that requires 2.8 volts for illumination. The white LED 32 projects a well defined beam of light which is located at the tip of the baton 10. The automatic switching of the LEDS contained within the tubular structure by virtue of the different forward voltage potentials is required by the various LEDS 30, 32. The forward voltage drop of the white LED 32 is 3.2 volts in combination with the red LED 30 which is 1.7 volts.

What has been described and illustrated is a tubular structure made of a plastic material such as polypropylene, polyethylene, polyurethane or similar type plastic that exhibits an optical phenomena such that when the plastic tube is exposed to a light source contained within the tube, the entire tube tends to glow. This phenomena is due to the re-radiation of photons within the molecular structure of the polypropylene, polyethylene, and polyurethane or similar type plastic. This glowing phenomena is similar in appearance to a neon tube.

Furthermore, if the plastic tube is colored with a pigment such as a fluorescent red dye (or other color) and the tube is internally exposed to a red light source (a red LED or other color) the re-radiation phenomena of photons is greatly enhanced. This enhancement is caused by the affinity of the flourescent dye pigment embedded within the plastic molecules of the tube for the red wavelength of light emitted from the red LED (or other color) contained within the tube.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A luminary and flashlight contained within a tubular structure, said tubular structure having at least two modes, an illumination mode and a flashlight mode, comprising:

a tubular body having a hollow interior and fluted exterior;

a plurality of light elements for illuminating and emitting light and some of said plurality of light elements being accommodated within said hollow interior of said tubular body, said plurality of light elements including at least one rear lighting means for illuminating and at least one forward lighting means for emitting a light;

a power source positioned within said hollow interior of said tubular body, said power source having electrical contacts capable of being in electrical communication with said plurality of lighting elements for providing power to said plurality of lighting elements;

said tubular body further includes a contiguous forward portion and rearward portion, said forward portion including a forward distal opening communicating with said hollow interior of said tubular body, and said rearward portion includes a rear distal opening communicating with said hollow interior of said tubular body;

a front cap having surfaces defining a forward hemispheric shape and a hollow elongated tubular portion;

a laser lens assembly, said front cap and laser lens assembly being accommodated within said forward distal opening of said forward portion, said laser lens assembly cooperating with said front cap for directing said emitted light out said forward distal opening in a well-defined beam of light during the flashlight mode of operation; and a rear cap for receiving said rearward portion of said tubular body;

a sub assembly for receiving said at least one rear lighting means and connecting to said power source for illuminating the entire tubular body when in the illumination mode; and an annular shaped gasket having walls, said tubular shape of said rear cap and gasket are accommodated within said rear distal opening of said rearward portion.

2. The luminary and flashlight contained within a tubular structure, as recited in claim 1, wherein the tubular body is made of a plastic material such as polypropylene, polyethylene, polyurethane or similar type plastic that exhibits an optical phenomena such that when the plastic tubular body is exposed to a light source contained within the tube, the entire tubular body glows.

3. The luminary and flashlight contained within a tubular structure, as recited in claim 2, wherein the optical phenomena is due to the re-radiation of photons within the molecular structure of the polypropylene, polyethylene, and polyurethane or similar type plastic.

4. The luminary and flashlight contained within a tubular structure, as recited in claim 3, wherein coloring the tubular structure with a pigment such as a fluorescent red dye and internally exposing the structure to a red light source enhances the re-radiation phenomena of photons.

5. The luminary and flashlight contained within a tubular structure, as recited in claim 4, wherein said enhancement is caused by an affinity of the florescent dye pigment embedded within the plastic molecules of the tubular structure for the red wavelength of light emitted from a red LED contained within the tubular structure.

6. The luminary and flashlight contained within a tubular structure, as recited in claim 1, wherein said laser lens assembly includes a lens tip with an optical focusing lens for projecting said well defined beam of light.

7. The luminary and flashlight contained within a tubular structure, as recited in claim 1, comprising:

a battery ejection mechanism having a screw type positive contact and an ejection spring negative contact, said ejection spring contact for providing an electrical contact and facilitating easy removal of the battery, wherein the battery being under spring pressure when the rear cap is screwed into the tubular body, so that when the rear cap is removed the spring tension is released and the battery is ejected.

* * * * *